US011162682B2

(12) United States Patent
Rogers et al.

(10) Patent No.: US 11,162,682 B2
(45) Date of Patent: Nov. 2, 2021

(54) FUEL INJECTOR

(71) Applicant: Solar Turbines Incorporated, San Diego, CA (US)

(72) Inventors: Richard A. Rogers, San Diego, CA (US); Drew Allen Dominique, Lakeside, CA (US); Timothy Ray Evans, Jr., San Diego, CA (US); Jonathan Gerrard Duckers, San Diego, CA (US); Stephen Burke, Brantford (CA); Robert Archer, San Diego, CA (US); Stefan Helmuth Humer, San Diego, CA (US); Hanjie Lee, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 215 days.

(21) Appl. No.: 16/600,124

(22) Filed: Oct. 11, 2019

(65) Prior Publication Data

US 2021/0108800 A1 Apr. 15, 2021

(51) Int. Cl.
*F23R 3/28* (2006.01)
*F23R 3/14* (2006.01)

(52) U.S. Cl.
CPC ..... *F23R 3/283* (2013.01); *F23R 3/14* (2013.01); *F23R 3/286* (2013.01)

(58) Field of Classification Search
CPC .. F23R 3/283; F23R 3/14; F23R 3/286; F23R 3/343; F23C 2900/07001; F23C 7/004
See application file for complete search history.

(56) References Cited

U.S. PATENT DOCUMENTS

| | | | | |
|---|---|---|---|---|
| 3,937,011 | A * | 2/1976 | Caruel | F23D 11/107 60/737 |
| 4,735,044 | A * | 4/1988 | Richey | F02C 7/22 239/424 |
| 5,404,711 | A | 4/1995 | Rajput | |
| 5,675,971 | A * | 10/1997 | Angel | F23R 3/286 239/405 |
| 5,680,766 | A * | 10/1997 | Joshi | F23C 7/004 239/405 |
| 5,778,676 | A * | 7/1998 | Joshi | F23D 11/101 239/405 |
| 7,703,288 | B2 | 4/2010 | Rogers | |
| 9,920,693 | B2 | 3/2018 | Hanson | |
| 10,215,414 | B2 | 2/2019 | Martini et al. | |
| 10,295,188 | B2 * | 5/2019 | Carrotte | F23R 3/16 |
| 10,317,084 | B2 | 6/2019 | Siders et al. | |
| 10,364,751 | B2 | 7/2019 | Ryon et al. | |
| 2008/0078181 | A1 | 4/2008 | Mueller | |

(Continued)

*Primary Examiner* — Scott J Walthour
*Assistant Examiner* — Todd N Jordan
(74) *Attorney, Agent, or Firm* — Procopio, Cory, Hargreaves & Savitch LLP

(57) ABSTRACT

A fuel injector for a combustor of a gas turbine engine is disclosed herein. The fuel injector includes a fuel stem assembly for receiving and distributing fuel and an injector head receiving fuel from the fuel stem assembly. The injector head can include an injector body, swirler vanes, a pilot assembly, passages, and fuel galleries. The pilot assembly can include pilot struts and a pilot tube. The swirler vanes and pilot struts can include passages to transport the pilot fuel from the fuel stem assembly to the pilot tube.

20 Claims, 4 Drawing Sheets

(56) References Cited

U.S. PATENT DOCUMENTS

| | | | | |
|---|---|---|---|---|
| 2014/0367494 | A1 | 12/2014 | Donovan | |
| 2016/0003157 | A1 | 1/2016 | Ott et al. | |
| 2016/0265780 | A1 | 9/2016 | Patel | |
| 2017/0089582 | A1 | 3/2017 | Carrotte | |
| 2018/0163967 | A1* | 6/2018 | Arellano | F23R 3/286 |
| 2018/0304281 | A1 | 10/2018 | Wirtz et al. | |

* cited by examiner

FUEL INJECTOR

TECHNICAL FIELD

The present disclosure generally pertains to gas turbine engines. More particularly this application is directed toward a fuel injector for a gas turbine engine.

BACKGROUND

Gas turbine engines include compressor, combustor, and turbine sections. The combustor section includes fuel injectors that supply fuel for the combustion process. The configuration of features and parts of the fuel injector can have an impact on the performance characteristics of the fuel injector.

U.S. Pat. No. 7,703,288 to Rodgers describes fuel injection nozzles used for reducing NOx in gas turbine engines that have incorporated a variety of expensive and complicated techniques. The dual fuel injector reduces the formation of carbon monoxide, unburned hydrocarbons and nitrogen oxides within the combustion zone by providing a series of premixing chambers being in serially aligned relationship one to another. During operation of the dual fuel injector the premixing chambers have a liquid fluid and air or water and air being further mixed with additional air or a gaseous fluid and air. The liquid fluid and the gaseous fluid can be used simultaneously or individually depending on the availability of fluids.

The present disclosure is directed toward overcoming one or more of the problems discovered by the inventors or that is known in the art.

SUMMARY

A fuel injector for a gas turbine engine is disclosed herein. In embodiments the fuel injector includes a pilot fitting, a main fitting, a fuel stem, and an injector head. The fuel stem includes a fuel stem pilot passage proximate to and in fluid communication with the pilot fitting. The fuel stem further includes a fuel stem main passage proximate to and in fluid communication with the main fitting. The injector head includes an injector body. The injector body includes a fuel stem receiver encircling and connecting to the fuel stem. The injector body further includes a main fuel gallery proximate to and in fluid communication with the main passage and a pilot fuel gallery proximate to and in fluid communication with the pilot passage. A pilot assembly is positioned within the injector body. The injector head further includes a plurality of swirler vanes extending inward from the injector body to the pilot assembly. Each of the plurality of swirler vanes includes a swirler pilot passage extending from the injector body to the pilot assembly. The swirler pilot passage is in fluid communication with the pilot fuel gallery.

BRIEF DESCRIPTION OF THE FIGURES

The details of embodiments of the present disclosure, both as to their structure and operation, may be gleaned in part by study of the accompanying drawings, in which like reference numerals refer to like parts, and in which.

DETAILED DESCRIPTION

The detailed description set forth below, in connection with the accompanying drawings, is intended as a description of various embodiments and is not intended to represent the only embodiments in which the disclosure may be practiced. The detailed description includes specific details for the purpose of providing a thorough understanding of the embodiments. However, it will be apparent to those skilled in the art that embodiments of the invention can be practiced without these specific details. In some instances, well-known structures and components are shown in simplified form for brevity of description.

Figure 1:
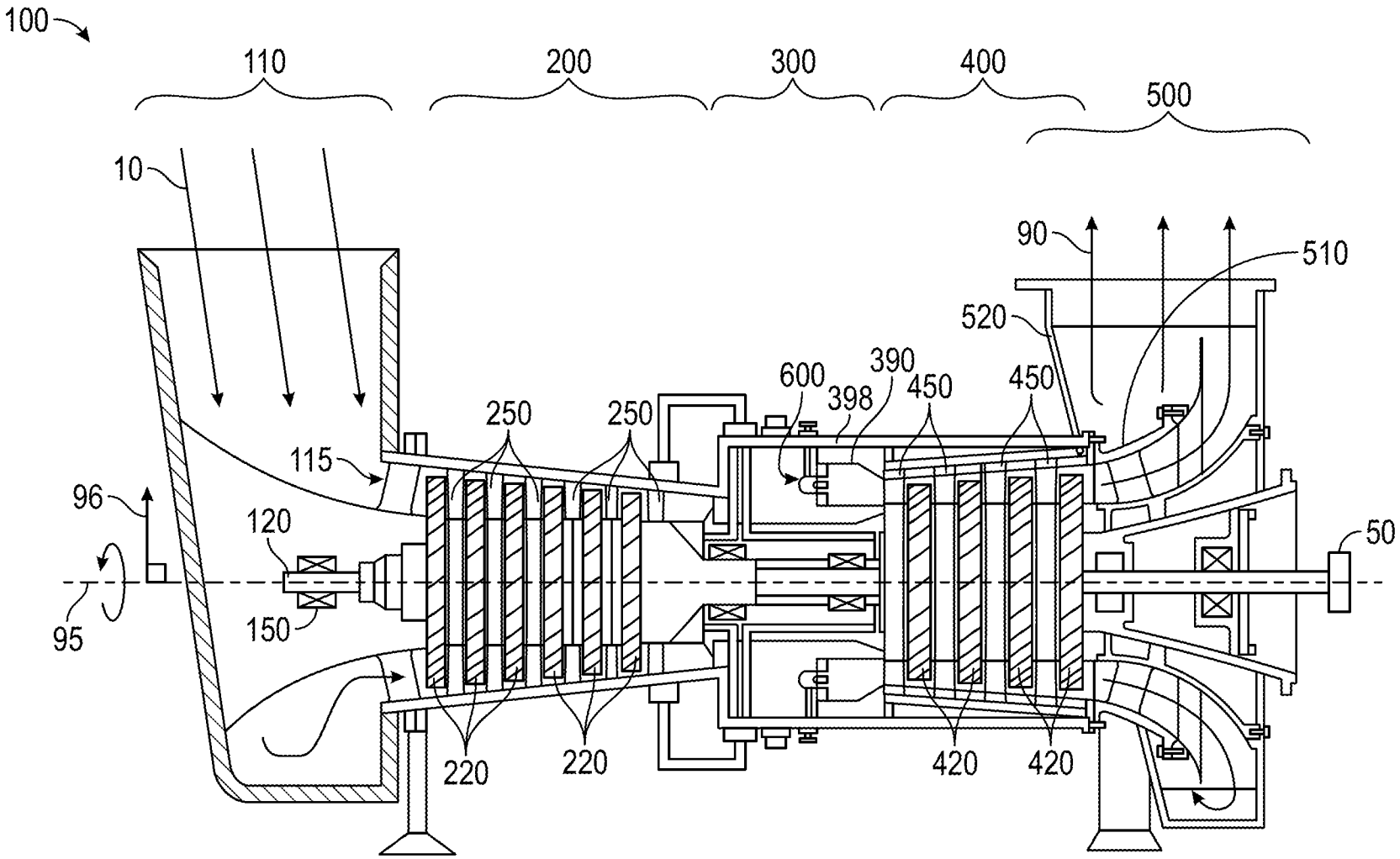
FIG. 1 is a schematic illustration of an exemplary gas turbine engine.

FIG. 1 is a schematic illustration of an exemplary gas turbine engine. Some of the surfaces and reference characters may have been left out or exaggerated (here and in other figures) for clarity and ease of explanation. Also, the disclosure may reference a forward and an aft direction. Generally, all references to "forward" and "aft" are associated with the flow direction of primary air (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine 100, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from, wherein a radial 96 may be in any direction perpendicular and radiating outward from center axis 95.

Where the drawing includes multiple instances of the same feature, for example bearing assemblies 150, the reference number is only shown in connection with one instance of the feature to improve the clarity and readability of the drawing. This is also true in other drawings which include multiple instances of the same feature.

Structurally, a gas turbine engine 100 includes an inlet 110, a compressor 200, a combustor 300, a turbine 400, an exhaust 500, and a power output coupling 50. The compressor 200 includes one or more compressor rotor assemblies 220. The combustor 300 includes one or more fuel injectors 600 and includes one or more combustion chambers 390. In the gas turbine engine 100 shown, each fuel injector 600 is installed into combustor 300 in the axial direction relative to center axis 95 through a combustor case 398.

The turbine 400 includes one or more turbine rotor assemblies 420. The exhaust 500 includes an exhaust diffuser 510 and an exhaust collector 520.

As illustrated, both compressor rotor assembly 220 and turbine rotor assembly 420 are axial flow rotor assemblies, where each rotor assembly includes a rotor disk that is circumferentially populated with a plurality of airfoils ("rotor blades"). When installed, the rotor blades associated with one rotor disk are axially separated from the rotor blades associated with an adjacent disk by stationary vanes 250, 450 ("stator vanes" or "stators") circumferentially distributed in an annular casing.

In operation, a gas (typically air 10) enters the inlet 110 as a "working fluid", and is compressed by the compressor 200. In the compressor 200, the working fluid is compressed in an annular flow path 115 by the series of compressor rotor assemblies 220. In particular, the air 10 is compressed in numbered "stages", the stages being associated with each compressor rotor assembly 220. For example, "4th stage air" may be associated with the 4th compressor rotor assembly 220 in the downstream or "aft" direction—going from the inlet 110 towards the exhaust 500). Likewise, each turbine rotor assembly 420 may be associated with a numbered stage. For example, first stage turbine rotor assembly is the forward most of the turbine rotor assemblies 420. However, other numbering/naming conventions may also be used.

Once compressed air 10 leaves the compressor 200, it enters the combustor 300, where it is diffused and fuel is added. The fuel injector 600 may include multiple fuel circuits for delivering fuel to the combustion chamber 390, such as a pilot fuel circuit for pilot fuel and a main fuel circuit for main fuel. Air 10 and fuel are injected into the combustion chamber 390 via fuel injector 600 and ignited. After the combustion reaction, energy is then extracted from the combusted fuel/air mixture via the turbine 400 by each stage of the series of turbine rotor assemblies 420. Exhaust gas 90 may then be diffused in exhaust diffuser 510 and collected, redirected, and exit the system via an exhaust collector 520. Exhaust gas 90 may also be further processed (e.g., to reduce harmful emissions, and/or to recover heat from the exhaust gas 90).

One or more of the above components (or their subcomponents) may be made from stainless steel and/or durable, high temperature materials known as "superalloys". A superalloy, or high-performance alloy, is an alloy that exhibits excellent mechanical strength and creep resistance at high temperatures, good surface stability, and corrosion and oxidation resistance. Superalloys may include materials such as HASTELLOY, INCONEL, WASPALOY, RENE alloys, HAYNES alloys, INCOLOY, MP98T, TMS alloys, and CMSX single crystal alloys.

Figure 2:
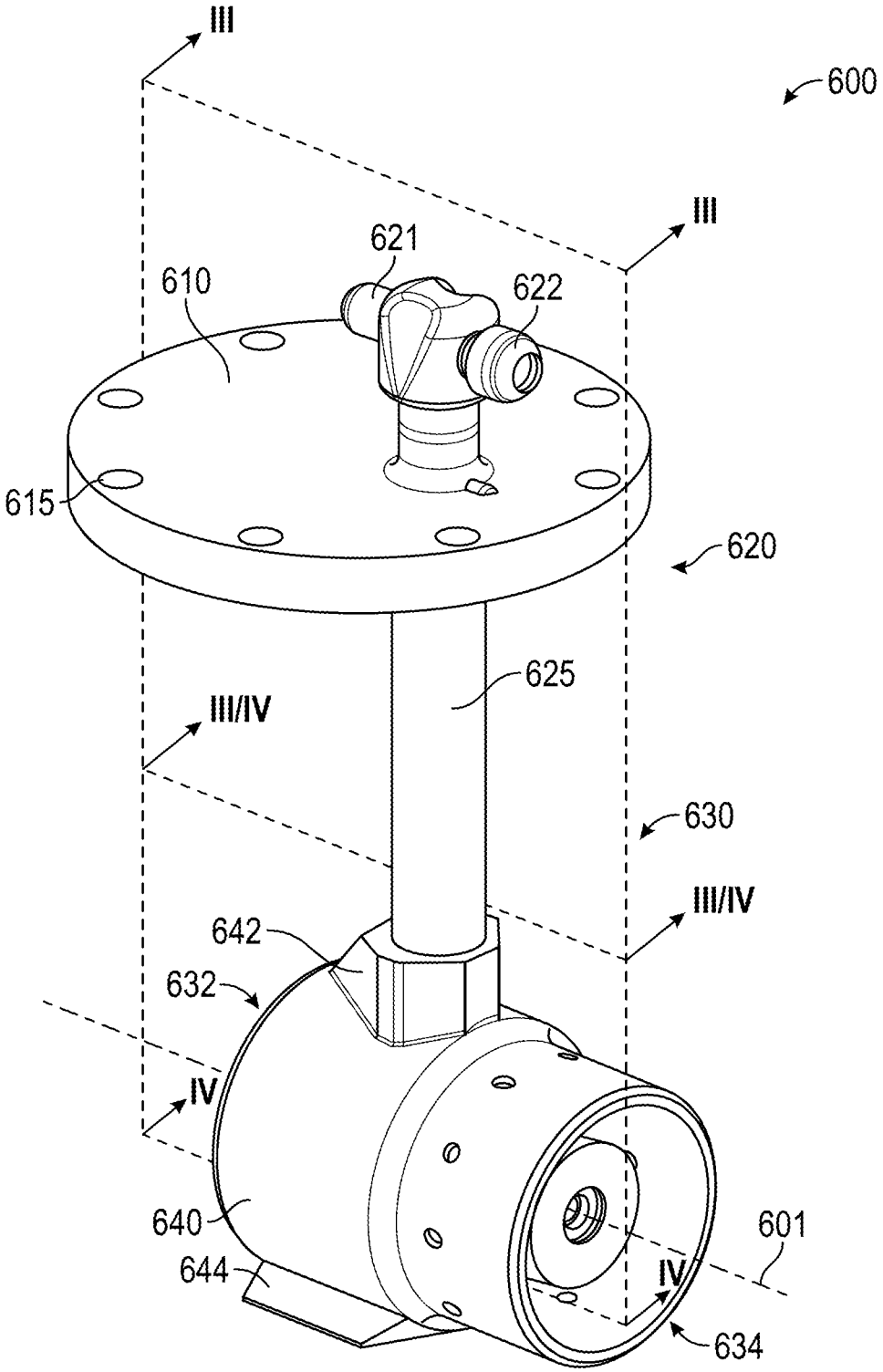
FIG. 2 is a perspective view of an embodiment of the fuel injector from FIG. 1.

FIG. 2 is a perspective view of the fuel injector 600 of FIG. 1. The fuel injector 600 can include a flange, a fuel stem assembly 620, and an injector head 630. The flange 610 may be a cylindrical disk and may include mounting holes 615 for fastening the fuel injector 600 to the combustor case 398.

The fuel stem assembly 620 can include a pilot fitting 621, a main fitting 622, and a fuel stem 625. The pilot fitting 621 can receive fuel from a pilot fuel source and be part of the pilot fuel circuit. In an embodiment the pilot fuel is a gas fuel. In other examples the pilot fuel is a liquid fuel. The pilot fitting 621 can be connected to the fuel stem 625.

The main fitting 622 can received fuel from a main fuel source and be part of the main fuel circuit. In an embodiment the main fuel is a gas fuel. In other examples the main fuel is a liquid fuel. In an example the pilot fuel and the main fuel are received from the same fuel source. Sometimes the pilot fuel and the main fuel are referred to as fuel. The main fitting 622 can be connected to the fuel stem 625.

The injector head 630 can include an injector body 640. The injector head can include an injector axis 601. In an embodiment shown, the injector axis 601 extends longitudinal to the injector head. All references to radial, axial, and circumferential directions and measures of the injector head 630 and the elements of the injector head 630 refer to the injector axis 601, and terms such as "inner" and "outer" generally indicate a lesser or greater radial distance from the injector axis 601.

The injector head 630 can include a fuel stem receiver 642 and an injector fastener 644. The fuel stem receiver 642 can extend outward from the injector body 640. In an embodiment the fuel stem receiver 642 can connect with the fuel stem 625. In an embodiment the fuel stem receiver 642 and the fuel stem 625 may be metallurgically bonded, such as by brazing or welding. The injector fastener 644 can extend outward from the injector body 640. The injector fastener 644 can be located opposite from the fuel stem receiver 642. The injector fastener 644 can be narrower adjacent to the injector body 640 than away from the injector body 640.

The injector head 630 can have a forward end 632 and an aft end 634 opposite the forward end 632. In an embodiment the forward end 632 can be referred to as the upstream end or upstream from the aft end 634. The aft end 634 can be referred to as the downstream end or downstream from the forward end 632.

Figure 3:
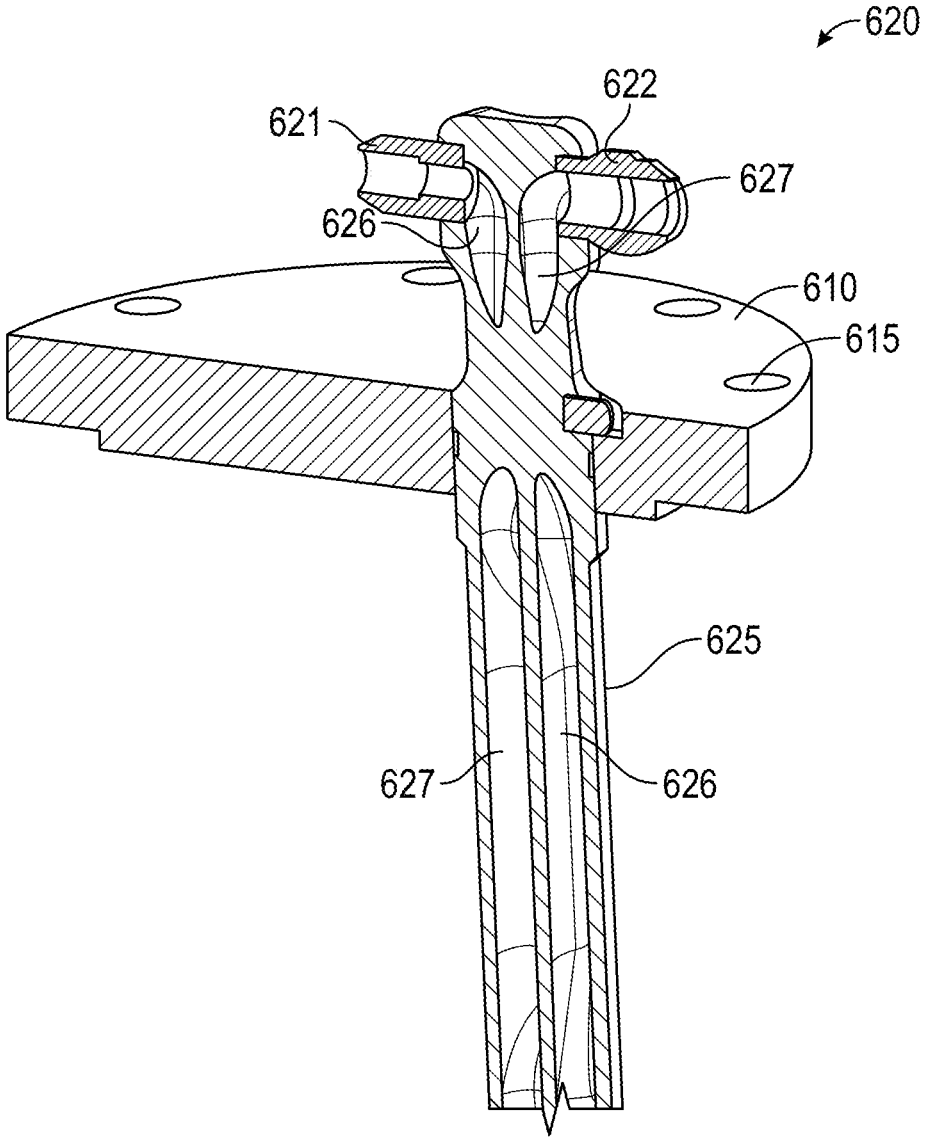
FIG. 3 is a cross-sectional view of the fuel stem assembly along plane III-III of FIG. 2.

FIG. 3 is a cross-sectional view of an embodiment of the fuel stem assembly along plane III-III of FIG. 2. The fuel stem 625 can be a generally cylindrical and extend through the flange 610.

The fuel stem 625 can include a fuel stem pilot passage 626 and a fuel stem main passage 627. The fuel stem pilot passage 626 can be in fluid communication with the pilot fitting 621 and be part of the pilot fuel circuit. The fuel stem main passage 627 can be in fluid communication with the main fitting 622 and be part of the main fuel circuit.

The fuel stem assembly 620 can be for receiving a main fuel and a pilot fuel and distributing the main fuel and pilot fuel to the injector head 630.

In an embodiment shown, the fuel stem pilot passage 626 and the fuel stem main passage 627 can twist within the fuel stem 625. In other words adjacent to pilot fitting 621 and the main fitting 622, the fuel stem main passage 627 can be closer to the aft end 634 of the injector head than the fuel stem pilot passage 626 and at a location away from the pilot fitting 621 and the main fitting 622 the fuel stem pilot passage 626 can closer to the aft end 634 of the injector head 630 than the fuel stem main passage 627. In an embodiment the fuel stem pilot passage 626 and the fuel stem main passage 627 twist proximate to the flange 610.

Figure 4:
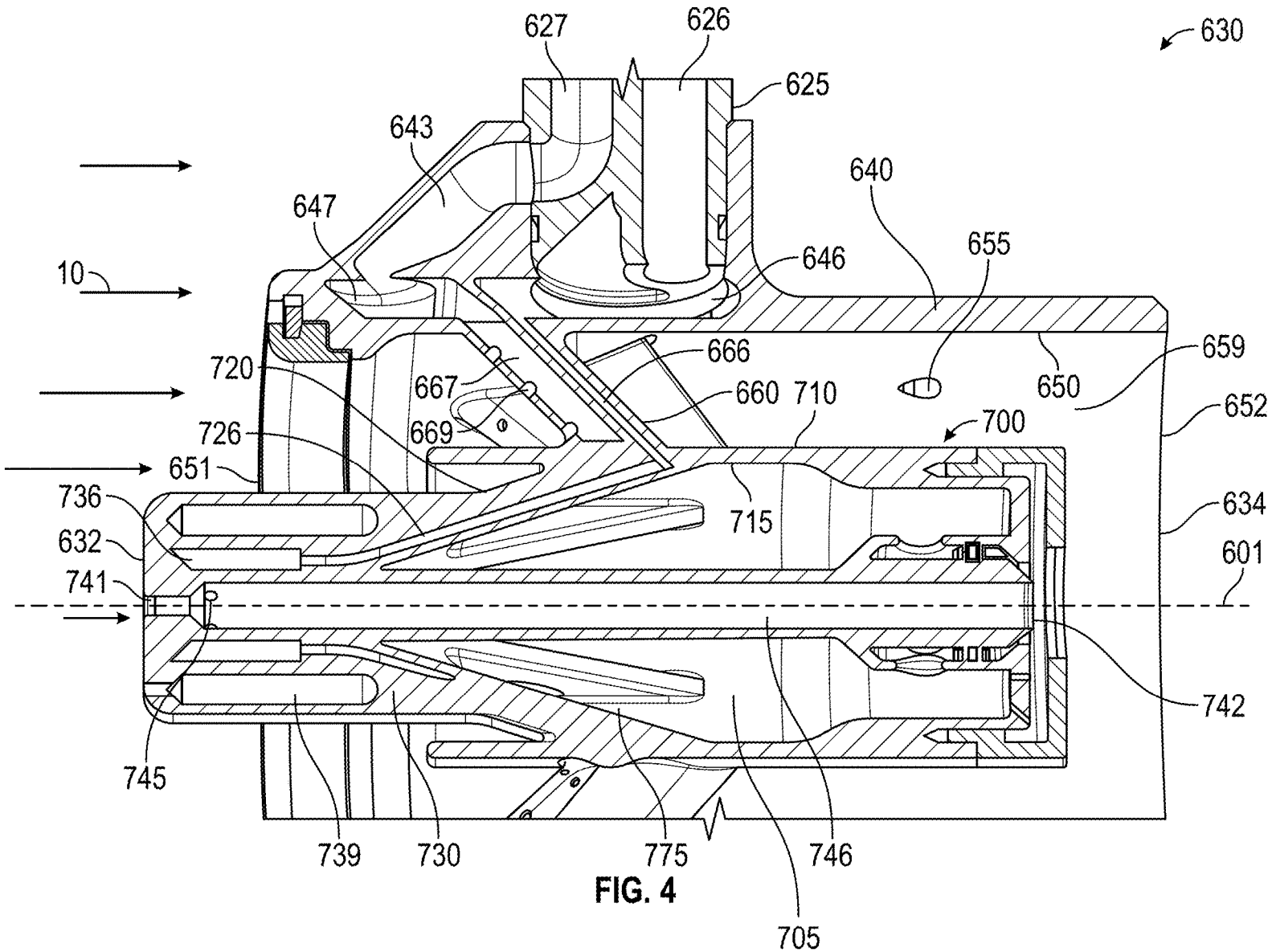
FIG. 4 is a cross-sectional view of an embodiment of the injector head along plane IV-IV of FIG. 2 with the bottom portion not shown.

FIG. 4 is a cross-sectional view of an embodiment of the injector head along plane IV-IV of FIG. 2 with the bottom portion not shown.

The fuel stem receiver 642 can include a fuel stem receiver main passage 643 in fluid communication with the fuel stem main passage 627. The fuel stem receiver main passage 643 can be part of the main fuel circuit.

The injector body 640 can include an injector body inner surface 650 forming a bore along the injector axis 601. The injector body inner surface 650 can be positioned inward of the fuel stem receiver 642.

The injector body 640 can include a main fuel gallery 647 and a first pilot fuel gallery 646 (sometimes referred to as pilot fuel gallery). The main fuel gallery 647 can be positioned between the injector body inner surface 650 and the fuel stem receiver 642. In an embodiment the main fuel gallery 647 is formed by space between the injector body inner surface 650 and the fuel stem receiver main passage 643. The main fuel gallery 647 can circumferentially extend around the injector axis 601. The main fuel gallery 647 can be in fluid communication with the fuel stem receiver main passage 643 and be part of the main fuel circuit.

The first pilot fuel gallery 646 can be positioned downstream of the main fuel gallery 647. In an embodiment the first pilot fuel gallery 646 can be positioned closer to the aft end 634 of the injector head 630 than the main fuel gallery 647.

The first pilot fuel gallery 646 can be positioned between the injector body inner surface 650 and the fuel stem receiver 642. The first pilot fuel gallery 646 can circumferentially extend around the injector axis 601. In an embodiment the first pilot fuel gallery 646 is formed by the space between the injector body inner surface 650 and the fuel stem pilot passage 626. The pilot fuel gallery 646 can be in fluid communication with the fuel stem pilot passage 626 and be part of the pilot fuel circuit.

The injector body inner surface 650 can circumferentially extend around the injector axis 601. The injector body can have a premix passage forward end 651 and a premix passage aft end 652 opposite from the premix passage forward end 651. In an embodiment the premix passage aft end 652 and the aft end 634 of the injector head 630 are the same feature. The premix passage forward end 651 can be proximate to the main fuel gallery 647.

The injector body 640 may include openings 655 that allow compressor discharge air 10 to enter into the injector head 630.

The injector head 630 can include swirler vanes 660. The swirler vanes 660 can extend inward from the injector body 640. The swirler vanes 660 may have a portion that is wedge shaped and may have the tip of the wedge truncated or removed. The swirler vanes 660 may include other shapes configured to direct air through the injector body. The swirler vanes 660 can extend diagonally from the injector body inner surface 650 toward the aft end 634.

Each of the swirler vanes 660 may include a swirler main passage 667 and swirler outlets 669. The swirler main passage 667 can extend inward from the injector body 640. The swirler main passage 667 can extend through the injector body inner surface 650 and be adjacent to the main fuel gallery 647. The swirler main passage 667 can be part of the main fuel circuit.

The swirler outlets 669 can be in fluid communication with the swirler main passage 667.

The swirler vanes 660 can include a swirler pilot passage 666 extending through the swirler vane 660. In an embodiment the swirler pilot passage 666 is positioned between the swirler main passage 667 and the aft end 634. The swirler pilot passage 666 can extend through the injector body inner surface 650 and be adjacent to the pilot fuel gallery 646. The swirler pilot passage 666 can be part of the pilot fuel circuit.

The injector head 630 can include a pilot assembly 700. The pilot assembly 700 can include an outer pilot surface 710 an inner pilot surface 715, pilot struts 720, a pilot shield 730, and a pilot tube 746. In an embodiment, the outer pilot surface 710 can be located inward of the injector body 640. The swirler vanes 660 can extend from the injector body inner 650 to the outer pilot surface 710. The outer pilot surface 710 can circumferentially extend around the injector axis 601. The swirler main passage 667 may not extend into the outer pilot surface 710. In an embodiment the swirler pilot passage 666 extends from adjacent to the first pilot fuel gallery 646 and into the pilot assembly 700. The swirler pilot passage can extend through the outer pilot surface 710.

The outer pilot surface 710 can circumferentially extend around the injector axis 601. The outer pilot surface 710 can be positioned outward of the pilot shield 730. The space between the injector body inner surface 650 and the outer pilot surface 710 can form a premix passage 659.

The inner pilot surface 715 can be positioned inward of the outer pilot surface 710. The inner pilot surface 715 can circumferentially extend around the injector axis 601 and form a pilot chamber 705.

The pilot struts 720 can extend from the inner pilot surface 715 to the pilot shield 730. In an embodiment the pilot struts 720 extend diagonally towards the forward end 632 of the injector head 630. The pilot struts 720 can be radially positioned around the injector axis 601. The pilot struts 720 can be spaced apart and form feed air passages 775 between adjacent pilot struts 720, the pilot shield 730, and the inner pilot surface 715. The feed air passages 775 can direct discharge air 10 into the pilot chamber 705. Each pilot strut 720 may correspond with a specific swirler vane 660. In an embodiment, the number of pilot struts 720 can equal the number of swirler vanes 660. Each pilot strut 720 can extend from proximate to the interface between the swirler vane 660 and the pilot assembly 700.

The pilot struts 720 can include strut pilot passages 726. The strut pilot passage 726 can be in fluid communication with the swirler pilot passage 666. The strut pilot passage 726 can extend into the pilot shield 730. In an example the strut pilot passage 726 can extend through the inner pilot surface 715. In an embodiment, the strut pilot passage 726 can extend inward from adjacent the swirler pilot passage 666. The strut pilot passage 726 can extend from proximate the outer pilot surface 710 towards the forward end 632 of the injector head 630. The strut pilot passage 720 can extend inward from the inner pilot surface 715. The strut pilot passage 726 can be part of the pilot fuel circuit.

The pilot shield 730 can circumferentially extend around the injector axis 601. The pilot shield 730 can be positioned inward of the inner pilot surface 715. The pilot shield 730 can form the forward end 632 of the injector head 630. The pilot shield 730 can be positioned proximate to the premix passage forward end 651. The pilot shield 730 can extend laterally from the pilot struts 720. A portion of the pilot shield 730 can be positioned within the pilot chamber 705.

The pilot shield 730 can include a portion of the strut pilot passage 726, a second pilot fuel gallery 736, a pilot tube inlet 741, pilot fuel passages 745, and a portion of the pilot tube 746.

The second pilot fuel gallery 736 can circumferentially extend around the injector axis 601. The second pilot fuel gallery 736 can be in fluid communication with the strut pilot passages 726. The second pilot fuel gallery 736 can extend from adjacent to the strut pilot passages 726 towards the forward end 632. The second pilot fuel gallery 736 can be part of the pilot fuel circuit.

The pilot shield 730 can include a pilot cavity 739. can circumferentially extend around the injector axis 601. The pilot cavity 739 can help reduce the material needed to manufacture the injector head 630.

The pilot tube 746 can circumferentially extend around the injector axis 601. The pilot tube 746 can extend laterally along the injector axis 601. The pilot tube 746 can have a pilot tube inlet 741 located proximate to the forward end 632. The pilot tube inlet 741 can be in fluid communication with discharge air 10. In other words, the pilot tube inlet 741 can allow air 10 to enter the pilot tube 746.

Pilot fuel passages 745 can extend from the second pilot fuel gallery 736 to the pilot tube 746 allowing the pilot tube 746 to be in fluid communication with the second pilot fuel gallery 736. The pilot fuel passages 745 can be located proximate to the pilot tube inlet 741. The pilot tube 746 can have a pilot tube outlet 742 opposite from the pilot tube inlet 741. The pilot tube 746 can be part of the pilot fuel circuit.

INDUSTRIAL APPLICABILITY

The present disclosure generally applies to fuel injectors 600 for gas turbine engines 100. The described embodiments are not limited to use in conjunction with a particular type of gas turbine engine 100, but rather may be applied to stationary or motive gas turbine engines, or any variant thereof. Gas turbine engines 100, and thus their components, may be suited for any number of industrial applications, such as, but not limited to, various aspects of the oil and natural gas industry (including include transmission, gathering, storage, withdrawal, and lifting of oil and natural gas), power generation industry, cogeneration, aerospace and transportation industry, to name a few examples.

Existing fuel injectors utilize external tubes and passages to deliver pilot fuel to a pilot tube. These external tubes and passages can impede discharge air entering a premix passage and have unwanted effects on the overall efficiency and efficacy of the fuel injector.

The disclosed fuel injector 600 utilizes passages 666 within the swirler vanes 660 to deliver fuel to the pilot tube 746 without additional structures impeding discharge air 10 entering the premix passage 659.

The fuel injector 600 can include a fuel circuit. In an embodiment the fuel injector 600 can include a pilot fuel circuit and a main fuel circuit.

The fuel injector 600 can receive fuel at the pilot fitting 621 and distribute the fuel via the pilot circuit. The pilot fuel circuit can continue from the pilot fitting 621 and through the fuel stem pilot passage 626. In some gas turbine 100 configurations it is beneficial to position the main fitting 622 downstream of the pilot fitting 621 to facilitate connections to fuel supply lines. In an embodiment the fuel stem pilot passage 626 twist with the fuel stem main passage 627 to position the fuel stem pilot passage 626 to be downstream of the fuel stem main passage 627 while positioning the main fitting 622 downstream of the pilot fitting 621.

The pilot fuel circuit can further continue from the fuel stem pilot passage 626 to the first pilot fuel gallery 646. Fuel is collected within the first pilot fuel gallery 646. The pilot fuel circuit can continue further with the swirler pilot passages 666 connecting with the first pilot fuel gallery 646 at multiple locations. The fuel is distributed from the first pilot fuel gallery 646 to the strut pilot passages 726 via the swirler pilot passage 666. The pilot fuel circuit can continue through the strut pilot passages 726 to the second pilot fuel gallery 736. The second pilot fuel gallery 736 collects the fuel from the strut pilot passages 726 and distributed around the injector axis 601 proximate to the pilot tube 746. The pilot fuel circuit can continue further with the pilot fuel passage 745 connecting with the second pilot fuel gallery 736 at multiple locations. The fuel is distributed from the second pilot fuel gallery 736 to the pilot tube 746 via the pilot fuel passages 745. The pilot fuel circuit continues with fuel entering the pilot tube 746 and mixing with discharge air 10 entering through the pilot tube inlet 741. The air and fuel fixture can be distributed through the pilot tube 746 and exit out of the pilot tube outlet 742 to be combusted within the combustion chamber 390.

The fuel injector 600 can receive fuel at the main fitting 622 and distribute the fuel via the main circuit. The main fuel circuit can continue from the main fitting 622 and through the fuel stem main passage 627.

The main fuel circuit can continue from the fuel stem main passage 627 to the fuel stem receiver main passage 643. The main fuel circuit can further continue from the fuel stem receiver main passage 643 to the main fuel gallery 647. Fuel is collected within the main fuel gallery 647. The main fuel circuit can continue further with the swirler main passages 667 connecting with the main fuel gallery 647 at multiple locations. The fuel is distributed from the main fuel gallery 647 to the swirler outlets 669 via the swirler main passage 667.

The main fuel circuit continues with fuel exiting the swirler outlets 669 and entering the premix passage and mixing with discharge air 10 entering into the premix passage 659 proximate to the premix passage forward end 651. The air and fuel mixture can be distributed through the premix passage 659 and exit out of the premix passage 659 proximate to the premix passage aft end 652 to be combusted within the combustion chamber 390.

The fuel injector 600 can be manufactured by additive manufacturing and can reduce the number of separate pieces needed to assembly the fuel injector 600. The reduced number of pieces can reduce fuel injector 600 assembly time and cost. For example, the fuel stem 625 can be manufactured as one piece and be from a single parent material and the injector head 630 can be manufactured as another piece and be from a single parent material. The fuel stem 625 material and the injector head 630 material can be substantially similar. The similarity in materials can improve connection between the fuel stem 625 and the injector head 630 through connection methods such as brazing.

In other examples the fuel injector 600 can be manufactured in part by forging and/or casting.

Although this disclosure has been shown and described with respect to detailed embodiments thereof, it will be understood by those skilled in the art that various changes in form and detail thereof may be made without departing from the spirit and scope of the claimed disclosure. Accordingly, the preceding detailed description is merely exemplary in nature and is not intended to limit the disclosure or the application and uses of the disclosure. In particular, the described embodiments are not limited to use in conjunction with a particular type of gas turbine engine. For example, the described embodiments may be applied to stationary or motive gas turbine engines, or any variant thereof. Furthermore, there is no intention to be bound by any theory presented in any preceding section. It is also understood that the illustrations may include exaggerated dimensions and graphical representation to better illustrate the referenced items shown, and are not consider limiting unless expressly stated as such.

It will be understood that the benefits and advantages described above may relate to one embodiment or may relate to several embodiments. The embodiments are not limited to those that solve any or all of the stated problems or those that have any or all of the stated benefits and advantages.

What is claimed is:

1. A fuel injector for a gas turbine engine, the fuel injector comprising:

a pilot fitting;

a main fitting;

a fuel stem having:

a fuel stem pilot passage proximate to and in fluid communication with the pilot fitting, and a fuel stem main passage proximate to and in fluid communication with the main fitting; and an injector head having:

an injector body including:

a fuel stem receiver encircling and connecting to the fuel stem, and a main fuel gallery proximate to and in fluid communication with the fuel stem main passage, a pilot fuel gallery proximate to and in fluid communication with the fuel stem pilot passage, a pilot assembly positioned within the injector body, the pilot assembly having:

a pilot tube, a plurality of pilot struts, each pilot strut having a strut pilot passage, and a plurality of feed air passages, wherein each feed air passages is defined between adjacent pilot struts of the plurality of pilot struts, and a plurality of swirler vanes extending inward from the injector body to the pilot assembly, each of the plurality of swirler vanes including:

a swirler pilot passage extending from the injector body to the pilot assembly, the swirler pilot passage in fluid communication with the pilot fuel gallery, wherein a first pilot fuel circuit is provided between the pilot fuel gallery and the pilot tube, the first pilot fuel circuit comprising a first swirler pilot passage of a first swirler vane of the plurality of swirler vanes and a first strut pilot passage of a first pilot strut of the plurality of pilot struts.

2. The fuel injector of claim 1, wherein the injector head further comprises an aft end, wherein the main fitting is closer to the aft end than the pilot fitting and the pilot fuel gallery is closer to the aft end than the main fuel gallery.

3. The fuel injector of claim 1, wherein each of the plurality of swirler vanes further comprises:

a swirler main passage extending from the injector body towards the pilot assembly, the swirler main passage in fluid communication with the main fuel gallery; and a plurality of swirler outlets in fluid communication with the swirler main passage.

4. The fuel injector of claim 1, wherein the injector head is made of a single parent material.

5. The fuel injector of claim 1, wherein the injector head and the fuel stem are made of a substantially similar parent material.

6. A fuel injector for a gas turbine engine, the fuel injector comprising:

an injector head having:

an injector body including a fuel stem receiver, an injector body inner surface positioned inward of the fuel stem receiver and defining a bore in the injector body, a main fuel gallery positioned within the injector body, the main fuel gallery in fluid communication with the fuel stem receiver, a first pilot fuel gallery positioned within the injector body, the first pilot fuel gallery in fluid communication with the fuel stem receiver, a pilot assembly positioned within the bore of the injector body, the pilot assembly including:

a pilot tube, a plurality of pilot struts, each pilot strut having a strut pilot passage, a plurality of feed air passages, wherein each feed air passages is defined between adjacent pilot struts of the plurality of pilot struts, and a plurality of swirler vanes extending inward from the injector body to the pilot assembly, each of the plurality of swirler vanes including:

a swirler main passage extending from the injector body towards the pilot assembly, the swirler main passage in fluid communication with the main fuel gallery, and a swirler pilot passage extending from the injector body to the pilot assembly, the swirler pilot passage in fluid communication with the pilot fuel gallery, wherein the pilot fuel gallery, the pilot tube, a first swirler pilot passage of a first swirler vane of the plurality of swirler vanes, and a first strut pilot passage of a first pilot strut of the plurality of pilot struts are in fluid communication to provide a first pilot fuel flow.

7. The fuel injector of claim 6, wherein the plurality of pilot struts are spaced apart and extending inward from the pilot inner surface, and wherein each strut pilot passage is in fluid communication with the first pilot fuel gallery.

8. The fuel injector of claim 7, wherein the pilot assembly further comprises:

a pilot shield extending laterally from the plurality of pilot struts, the pilot shield including a second pilot fuel gallery in fluid communication with each strut pilot passage.

9. The fuel injector of claim 8, wherein the pilot tube is positioned inward of the pilot shield and the plurality of pilot struts, the pilot tube in fluid communication with the second pilot fuel gallery.

10. The fuel injector of claim 8, wherein the injector head further comprises a forward end proximate to the pilot shield and an aft end opposite of the forward end; wherein the first pilot fuel gallery is laterally closer to the aft end than the second pilot fuel gallery.

11. The fuel injector of claim 10, wherein the plurality of pilot struts each extend diagonally from proximate the plurality of swirler vanes towards the forward end.

12. The fuel injector of claim 10, wherein the first pilot fuel gallery is closer to the aft end than the main fuel gallery.

13. The fuel injector of claim 6, wherein the injector head is made of a single parent material.

14. A fuel injector for a gas turbine engine, the fuel injector comprising:

a pilot fitting;

a main fitting;

a fuel stem having:

a pilot passage in fluid communication with the pilot fitting, and a main passage in fluid communication with the main fitting; and an injector head having:

an injector body including:

a fuel stem receiver encircling and connecting to the fuel stem, a main fuel gallery proximate to and in fluid communication with the main passage, and a first pilot fuel gallery proximate to and in fluid communication with the pilot passage, a plurality of swirler vanes extending inward from the injector body, each of the plurality of swirler vanes including:

a swirler pilot passage extending inward from the injector body, the swirler pilot passage in fluid communication with the first pilot fuel gallery, and a pilot assembly positioned inward from the injector body, the pilot assembly including:

a pilot tube, an outer pilot surface, an inner pilot surface positioned inward of the outer pilot surface, a plurality of pilot struts, each pilot strut having a strut pilot passage, and a plurality of feed air passages, wherein each feed air passages is defined between adjacent pilot struts of the plurality of pilot struts, first swirler vane of the plurality of swirler vanes, and a first strut pilot passage of a first pilot strut of the plurality of pilot struts are in fluid communication to provide a first pilot fuel flow.

15. The fuel injector of claim 14, wherein the pilot assembly further comprises:

a pilot shield extending laterally from the plurality of pilot struts, the pilot shield including a second pilot fuel gallery in fluid communication with each strut pilot passage.

16. The fuel injector of claim 15, wherein the injector head further comprises:

a forward end proximate to the pilot shield and an aft end opposite of the forward end; and wherein the first pilot fuel gallery is laterally closer to the aft end than the main pilot fuel gallery.

17. The fuel injector of claim 16, wherein the main fitting is closer to the aft end than the pilot fitting.

18. The fuel injector of claim 15, wherein a portion of a pilot tube is positioned inward of the pilot tube shield and the inner pilot surface, the pilot tube in fluid communication with the second pilot fuel gallery.

19. The fuel injector of claim 14, wherein each of the plurality of swirler vanes further comprises:

a swirler main passage extending from the injector body towards the pilot assembly, the swirler main passage in fluid communication with the main fuel gallery; and a plurality of swirler outlets in fluid communication with the swirler main passage.

20. The fuel injector of claim 14, wherein the injector head is made of a single parent material.

* * * * *